US005377369A

United States Patent [19]

Shirai

[11] Patent Number: 5,377,369

[45] Date of Patent: Jan. 3, 1995

[54] BOTTOM STRUCTURE OF A BED

[75] Inventor: Kunito Shirai, Togane, Japan

[73] Assignee: Paramount Bed Company Limited, Tokyo, Japan

[21] Appl. No.: 170,715

[22] Filed: Dec. 21, 1993

[30] Foreign Application Priority Data

Dec. 25, 1992 [JP] Japan ..... 4-089070[U]

[51] Int. Cl.[6] ..... A47C 23/08

[52] U.S. Cl. ..... 5/236.1; 5/188; 5/191; 5/613

[58] Field of Search ..... 5/613, 617, 188, 191, 5/236.1, 400, 401, 465

[56] References Cited

U.S. PATENT DOCUMENTS

| | | | |
|---|---|---|---|
| 4,148,521 | 4/1979 | Van Hook | 297/118 |
| 4,785,487 | 11/1988 | Toran | 5/613 |
| 5,109,554 | 5/1992 | Borders et al. | 5/602 |

FOREIGN PATENT DOCUMENTS

| | | | |
|---|---|---|---|
| 106434 | 1/1927 | Austria | 5/236.1 |
| 51-30716 | 9/1976 | Japan . | |
| 54-26164 | 8/1979 | Japan . | |
| 54-37594 | 11/1979 | Japan . | |

*Primary Examiner*—Michael F. Trettel
*Attorney, Agent, or Firm*—Townsend & Banta

[57] ABSTRACT

The present invention provides a bottom structure for a bed having a bottom lifting mechanism, comprising parallel bottom strips, each strip having coupling grooves, located in the opposing faces of the bottom strips in the longitudinal direction, the strips being sequentially connected by coupling members. Each coupling member has portions corresponding to the coupling grooves at both ends of the coupling member which are incorporated as components of the bottom structure of the bed.

19 Claims, 3 Drawing Sheets

BOTTOM STRUCTURE OF A BED

CROSS- REFERENCE TO RELATED APPLICATION

This application claims the priority of Japanese Patent Application No. 89070/1992 filed on Dec. 25, 1992, which is incorporated herein by reference.

BACKGROUND OF THE INVENTION

1. Field of the Invention

The present invention relates to a bottom structure for a bed which can be bent to a proper curvature while allowing a patient to continue feeling relaxed even though the bottom is being partially lifted.

2. Description of Related Art

Many of the beds recently manufactured are equipped with a bottom lifting mechanism with various mechanisms being available. An ordinary liftable bed has a back bottom portion simply connected to a waist bottom portion. The waist bottom portion and a leg bottom portion are also simply connected. When the back bottom portion is lifted, the junction or joint between the back and waist portions acts as a pivot point, (i.e., a fulcrum is formed). When the leg portion is lifted, the joint between the waist and the leg bottom portions also acts a pivot point.

Therefore, as the back bottom portion is lifted up forming an angle, the angular space between the back and waist bottom portions near the joint is narrowed, and unless the angle fits the body of the patient in the bed, the waist, abdomen, and underside of the patient's legs are uncomfortably pressed by the mattress.

SUMMARY OF THE INVENTION

The present device has achieved a solution to the above cited problem. The object of the present invention is to provide a bottom structure for a bed which can be bent in appropriate curves to provide gentle curvature at the bent portions of the bed so as to minimize any displeasing pressure points for the patient.

To solve the above cited problem, the present invention provides a bottom structure for a bed having a bottom lifting mechanism, comprising parallel bottom strips, each strip having coupling grooves formed like circular arcs in cross section in the longitudinal direction, located in the opposing faces of the bottom strips in the longitudinal direction, the strips being sequentially connected by coupling members, each coupling member having bulbous or end portions corresponding to the coupling grooves at both the ends of the coupling member and incorporated as components of the bottom structure.

Further, the present invention also provides is a bottom structure for a bed having a bottom lifting mechanism, comprising parallel bottom strips, each strip having rectangular coupling grooves narrowed at the openings formed in the longitudinal direction, located in the opposing faces of the bottom strips in the longitudinal direction, the strips being sequentially connected by coupling members, each coupling member having widely spread tips or end portions at both ends of the coupling member corresponding to the rectangular coupling grooves to allow the bottom strips to be kept connected either more closely to each other or more widely apart, allowing the length of the bottom to be adjusted in the longitudinal direction of the bed.

In the above cited embodiments, the coupling members can be made of an elastic material.

Figure 1:
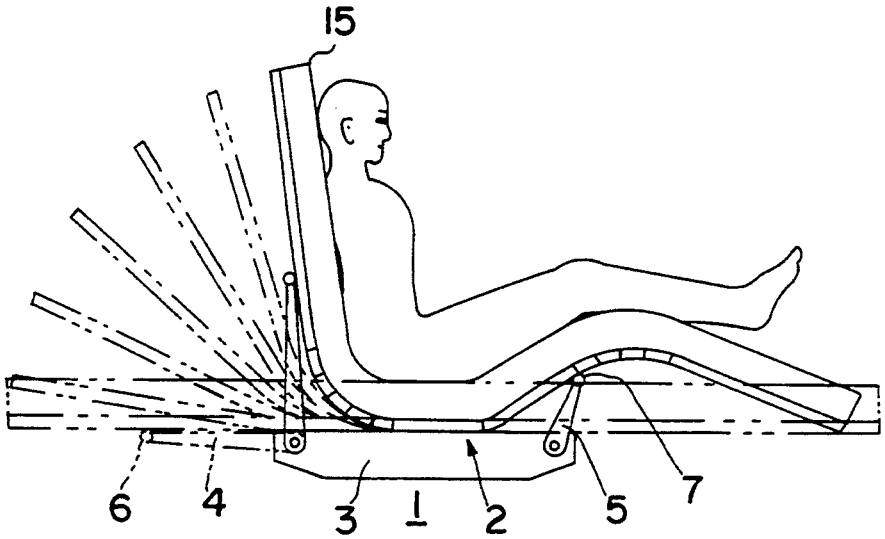
FIG. 1 is a side illustration showing a bed having a bottom lifting mechanism and the bottom structure of the present invention.

| | |
|---|---|
| 1 | Bed |
| 2 | Bottom |
| 3 | Actuator |
| 4 | Back Lifting Arm |
| 5 | Knee Lifting Arm |
| 6 and 7 | Roller |
| 8 | Bottom Strip |
| 9 | Coupling Member |
| 10 | Coupling Groove |
| 11 | Bulbous Portion |
| 12 | Opening |
| 13 | Rectangular Coupling Groove |
| 14 | Tip |
| 15 | Mattress |
| 16 | Flexible Sheet |
| 17 | Attachment Means |
| 18 | Gap |

DETAILED DESCRIPTION OF THE INVENTION

In the bed 1 of the present invention, plural parallel bottom strips 8 are used at the bendable portion or junction, between the back and waist portions of a bottom structure 2 and at the bendable portion corresponding to the joint between the waist and leg portions.

In one embodiment, each of the bottom strips 8 has coupling grooves 10 formed in the shape of circular arcs when viewed in cross section in the longitudinal direction (long horizontal plane of the bed when the bed is viewed completely flat), located in the opposing laces of the strips in the longitudinal direction.

In this embodiment, each of the coupling members 9 has bulbous portions 11 at both ends of the coupling member and the bulbous portions 11 are fitted in the coupling grooves 10 of the bottom strips 8 for sequential connection. The bottom strips 8 may be molded plastic and may be either hollow or solid. They may also be made of wood. The coupling members 9 may also be made of an elastic material. As a result of using the above described strips and coupling members at the bendable portions of the liftable bed, the bottom of the bed does not cause displeasing pressure points on a patient and can be bent smoothly.

If the bottom portions are partially lifted, the bottom strips are lifted, forming a gentle curve. The coupling members for mutually connecting the bottom strips are dislocated smoothly at both ends, without any resistance in the coupling grooves, and the respective bottom strips can be lifted to form predetermined angles with respect to the respectively adjacent bottom strips. If the width of the coupling members, the form of the coupling grooves, and their intervals are changed. The bending angle can be adjusted, and by changing the number of bottom strips, the length of the bending angle of bend can be adjusted.

Further, if the bottom strips are connected by coupling members fitted in rectangular coupling grooves with sufficient allowances, the overall length of the bottom of the bed can be adjusted in the longitudinal direction as well.

Moreover, if the coupling members are made of an elastic material, the bottom can be bent more smoothly, and even if a load is applied, the bottom remains resilient.

The bottom structure for a bed of the present information is described further below with reference to the attached drawings showing various embodiments.

FIG. 1 shows a liftable bed 1, in which the bottom structure of the present invention is applied. The bed 1 can lift the bottom portions 2 at the back and knee joints by an electric activator 3 provided below the bottom 2. The activator 3 is provided with back lifting arms 4 for lifting the back portion and knee lifting arms 5 for lifting the knee portion. The back lifting arms 4 contact the bottom 2 on the underside at a position corresponding to the back portion, through rollers 6, and the knee lifting arms contact the bottom 2 on the underside at a position near the waist and leg joint for lifting the patient's legs, through rollers 7.

In this bed 1, the bendable portion or junction between the back and waist portions of the bottom 2 and the portion or junction corresponding to the waist and leg joint for lifting the patient's legs are formed by parallel bottom strips 8 and coupling members 9 for connecting the bottom strips 8.

Each of the bottom strips 8 has coupling grooves 10 formed like circular arcs when viewed in cross section in the longitudinal direction, and are located in the opposite faces of the bottom strip in the longitudinal direction.

Figure 2:
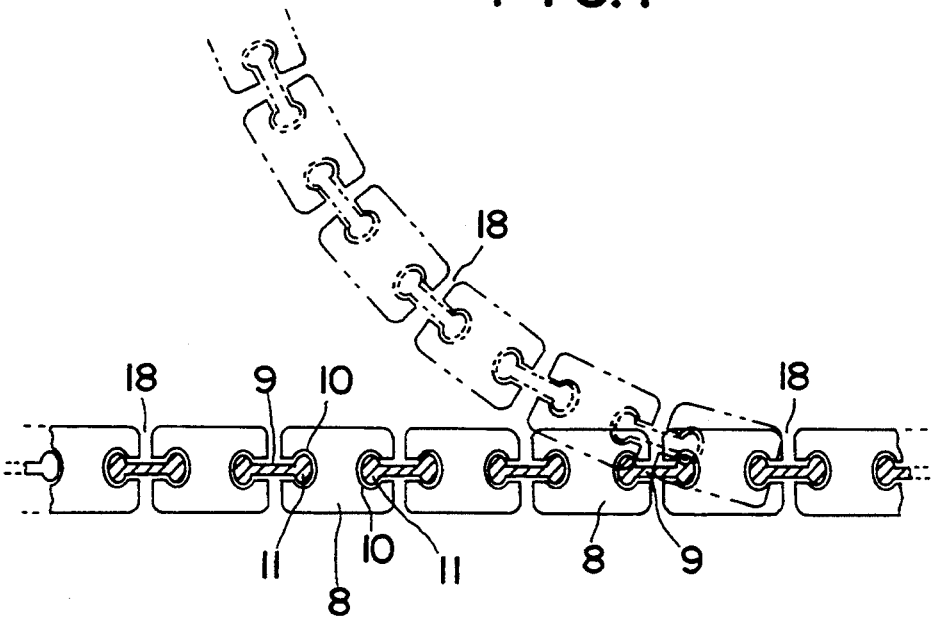
FIG. 2 is an enlarged sectional illustration showing one embodiment of bottom strips at a bendable portion of the bottom structure shown in FIG. 1.
Figure 3:
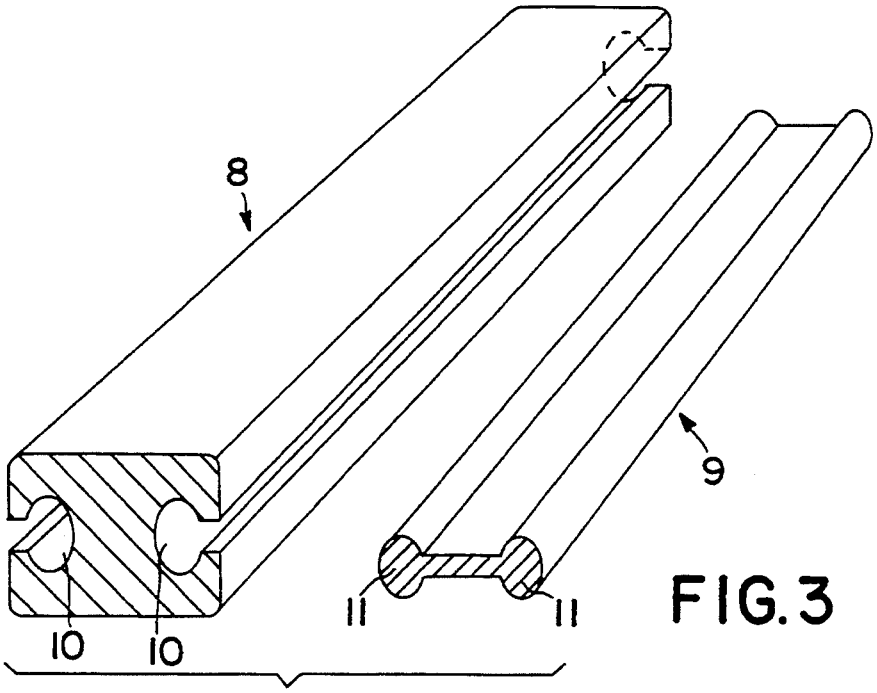
FIG. 3 is a perspective illustration of a bottom strip and coupling member shown in FIG. 2.
Figure 4:
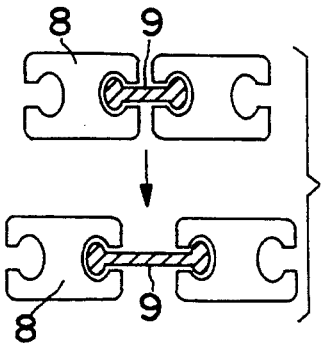
FIG. 4 is enlarged sectional illustrations showing other embodiments of the bottom strips and coupling members of the present invention.

In one embodiment shown in FIGS. 2 and 3, each of the coupling members 9 has bulbous portions 11 corresponding to the coupling grooves, at both ends of the coupling member. The bulbous portions 11 are fitted in the coupling grooves 10 of the bottom strips 8, forming a sequential connection of the bottom strips 8 (see FIG. 3).

The bottom strips 8 may be molded plastic and may be hollow or solid. They may also be made of wood. The coupling members 9 may also be made of an elastic material.

In the bed 1 with the above bottom structure, the activator 3 is started to partially lift the bottom 2 causing the bottom strips 8 to be raised, forming a gentle curve. The bulbous portions 11 at both the ends of the respective coupling members 9 connecting the bottom strips 8 are dislocated smoothly without any resistance in the coupling grooves formed like circular arcs when viewed in cross section, and the respective bottom strips 8 form predetermined angles against the respectively adjacent bottom strips 8.

Further, if the coupling members 9 are made of an elastic material, the curve is formed more smoothly, and even when a load is applied, the bottom remains resilient.

Thus, when the bottom is lifted at the back and knee portions, the bottom strips at the respective bent portions are raised to form a gentle curve. As a result the waist and abdomen, and the underside of the patient's legs at the bent portions are not uncomfortably pressed by the mattress.

Further, since the bottom strips 8 and the coupling members 9 can be standardized and are simple in structure, they can be easily mass-produced with an attendant in view of manufacturing cost advantage.

To connect the bottom strips 8, either of the bulbous portions 11 of a coupling members 9 is slid into the corresponding coupling groove 10 of a bottom strip 8 at a right angle to the longitudinal direction for fitting. Then, the other bulbous portion 11 of the coupling member 9 is slid into the corresponding coupling groove 10 of another bottom strip 8. In this way, a predetermined number of bottom strips 8 are sequentially connected forming the bendable bottom portion of the bottom structure of the bed.

If the width of the coupling members 9, the form of the coupling grooves, and their intervals are changed, the bending shape can be adjusted and furthermore, if the number of bottom strips is changed, the bent angle length can be adjusted.

Moreover, if one of the bottom strips 8 is broken during use, the broken bottom strip 8 or coupling member 9 only can be exchanged for easy maintenance.

Figure 5:
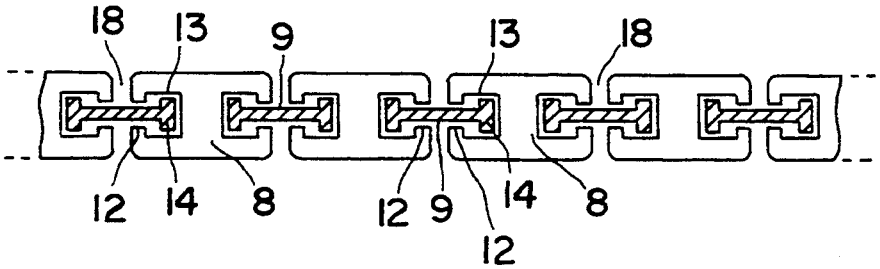
FIG. 5 is an enlarged sectional illustration showing a further embodiment of the bottom strips and coupling members of the present invention.

The bottom strips 8 and the coupling members 9 may also be formed as shown in FIG. 5. In this embodiment, each of the bottom strips 8 has rectangular coupling grooves 13 narrowed at their openings 12, formed in the longitudinal direction, located in the opposing faces of the bottom strip in the longitudinal direction. Each of the coupling members 9 may have widely spread tips 14 corresponding to the rectangular coupling grooves at both the ends of the coupling member, allowing the overall length of the bottom to be adjusted in the longitudinal direction of the bed.

If the bottom strips 8 are connected by the coupling members 9 with an allowable tolerance in the rectangular coupling grooves 13, the overall length of the bottom can be adjusted in the longitudinal direction of the bed. Further, if the coupling members 9 are made of an elastic material, the overall length of the bottom can be adjusted more flexibly and the bottom remaining resilient.

Figure 6:
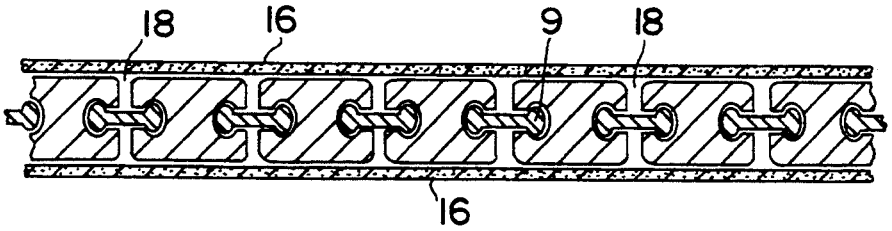
FIG. 6 is an illustration showing yet another embodiment where the bottom structure is covered with a flexible sheet.
Figure 7A:
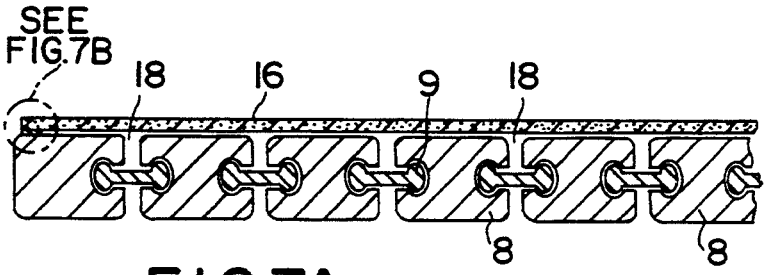
FIG. 7 is an illustration showing a still further embodiment where a flexible sheet is attached to the upper surface of the bottom structure.
Figure 7B:
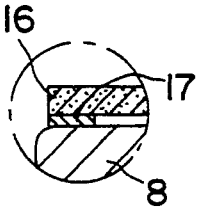
Figure 8A:
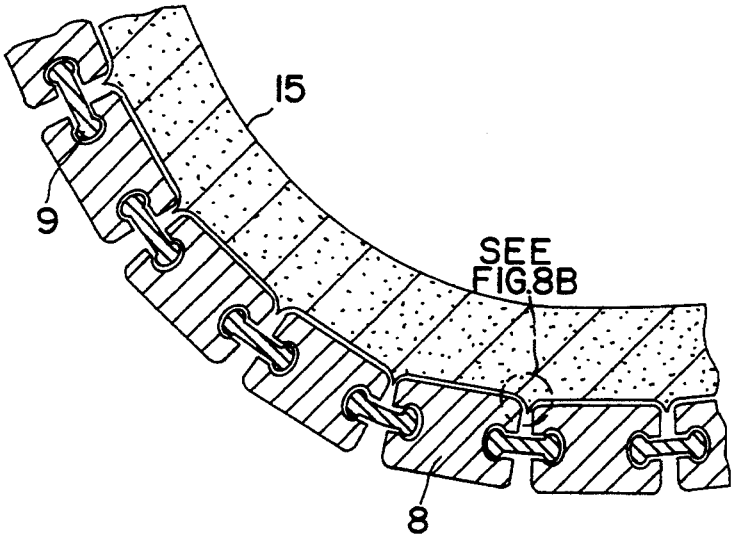
FIG. 8 is an illustration showing an embodiment where a mattress is caught in the gaps of the bottom structure.
Figure 8B:
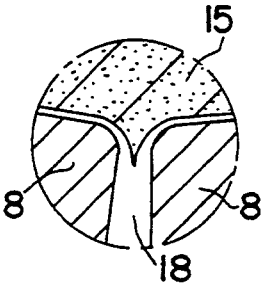

In the present invention, when the bottom structure is bent, a mattress 15 placed on the bottom structure might be caught in the gaps 18 formed between the bottom strips (see FIG. 8). To prevent this, the entire bottom may be covered with a flexible sheet 16 (see FIG. 6) or a flexible sheet 16 may be attached to the upper surface of the bottom structure (see FIG. 7).

The symbol 17 in FIG. 7 shows a means for fixing or attaching the flexible sheet 16 to the bottom structure.

When the bottom structures in FIG. 2 and FIG. 5 are bent, the gaps 18 formed on the upper side are pinched together. It may also happen that dust and dirt are collected in the gaps 18. However, if a flexible sheet 16 is provided, the accumulation of dust can be reduced or prevented. A flexible sheet 16 is preferably provided to permit easier cleaning. Further, it also prevents anything from being caught in the gaps formed during bending which might impair the function of the bottom structure.

As described above, the present invention provides the following advantages:

1. Since bottom strips of the same form connected by coupling members are used as bendable portions of the bottom structure of a bed, the bottom does not cause any feeling of displeasing pressure to a patient when the bottom structure is lifted at the back and knee positions.
2. Since each of the bottom strips and each of the coupling members are the same shape and form, they can be standardized so that they can be easily mass-produced, resulting in advantageous manufacturing costs.
3. In the bottom structure where the bulbous portions of the coupling members are engaged with the coupling grooves formed like circular arcs, the bottom can be very smoothly bent.
4. If the coupling grooves of the bottom strip, the bulbous portions of the coupling members and their intervals are changed, the angle of bend can be adjusted, and the bottom is adjustable.
5. If the number of the bottom strips connected is changed, the length of the bottom structure of the bed can be changed in the longitudinal direction.
6. If the coupling members are made of an elastic material, the bottom can be bent more smoothly, and when if a load is applied, the bottom remains resilient.
7. If a bottom strip is broken during use, the broken bottom strip can be readily changed allowing for easy maintenance.
8. When a flexible sheet is used to cover the bottom structure, the structure is easier to clean and materials are prevented from impeding the function of the bottom structure during bending.

What is claimed is:

1. A bottom structure for a bed with a bottom lifting mechanism comprising parallel bottom strips, each with coupling grooves formed like circular arcs in cross section in a longitudinal direction in opposite faces of the bottom strip, said bottom strips being sequentially connected by coupling members, each coupling member having bulbous portions corresponding to said coupling grooves at both ends of the coupling members.

2. A bottom structure for a bed according to claim 1, wherein the coupling members are made of an elastic material.

3. A bottom structure according to claim 1, further comprising a flexible sheet covering at least one surface of said bottom strips.

4. A bottom structure for a bed with a bottom lifting mechanism comprising parallel bottom strips, each with rectangular coupling grooves at openings formed in a longitudinal direction in opposite faces of the bottom strip, said bottom strips being sequentially connected by coupling members, each coupling member having widely spread tips corresponding to the rectangular coupling grooves at both ends of the coupling members, whereby to allow the bottom strips to be kept connected more closely to each other or more widely apart from each other, for allowing the length of the bottom to be adjusted in the longitudinal direction of the bed.

5. A bottom structure for a bed according to claim 4, wherein the coupling members are made of an elastic material.

6. A bottom structure according to claim 4, further comprising a flexible sheet covering at least one surface of said bottom strips.

7. A bottom structure for a bed having a bottom lifting mechanism comprising parallel bottom strips and coupling members wherein said bottom strips have four faces and each strip has a coupling groove formed in two of the opposite faces of said strip and wherein said strips are sequentially connected and secured by said coupling members wherein each coupling member has ends which are in locking engagement with said grooves in said strip member and being sufficiently smaller than said groove to facilitate movement of the coupling member in the groove and flex are between each strip such that when any section of the bed is lifted a gentle curve is formed.

8. A bottom structure according to claim 7, wherein said coupling grooves are formed in circular arcs in from said opposite face of said strip and said ends of said coupling member have a bulbous end portion corresponding to said coupling groove.

9. A bottom structure according to claim 7, wherein said coupling grooves are formed in circular arcs and recessed in from said opposite face of said strip and have a narrowed opening at said opposite face, and said ends of said coupling member have a bulbous end portion and a narrowed center corresponding to said coupling groove.

10. A bottom structure according to claim 7, wherein said coupling grooves are formed in a generally rectangular shape in from said opposite face of said strip and said ends of said coupling member have a tip end portion corresponding to said coupling groove.

11. A bottom structure according to claim 7, wherein said coupling grooves are formed in a generally rectangular shape and recessed in from said opposite face of said strip and have a narrowed opening at said face and said ends of said coupling member have a tip end portion and a narrowed center corresponding to said coupling groove.

12. A bottom structure according to claim 7, wherein said coupling grooves are formed in a generally rectangular shape and recessed in from said opposite face of said strip and have a narrowed opening at said face and said ends of said coupling member have a tip end portion and a narrowed center corresponding to said coupling groove and wherein said narrowed center is sufficiently elongated so as to allow said coupling member to slid inside said coupling groove such that said bottom structure can be adjusted in length.

13. A bottom structure according to claim 7, wherein said parallel bottom strips are comprised of plastic or wood.

14. A bottom structure according to claim 7, wherein said coupling members are comprised of plastic, elastic material or wood.

15. A bottom structure according to claim 7, wherein each parallel bottom strip is of equal size.

16. A bottom structure according to claim 7, wherein each coupling member is of equal size.

17. A bottom structure according to claim 7, wherein said bed has a back section and a waist section and said paralleled bottom strips and coupling members are located between said back section and said waist section.

18. A bottom structure according to claim 7, wherein said bed has a waist section and a leg section and said parallel bottom strips and coupling members are located between said waist section and said leg section.

19. A bottom structure according to claim 7, further comprising a flexible sheet covering at least one surface of said bottom strips.

* * * * *